US005383404A

United States Patent [19]

Nambu

[11] Patent Number: 5,383,404

[45] Date of Patent: Jan. 24, 1995

[54] PRINTING CYLINDER CLEANING APPARATUS

[75] Inventor: Tsutomu Nambu, Tokyo, Japan

[73] Assignee: Nikka Kabushiki Kaisha, Tokyo, Japan

[21] Appl. No.: 236,035

[22] Filed: May 2, 1994

[30] Foreign Application Priority Data

Jul. 15, 1993 [JP] Japan ..... 5-043657[U]

[51] Int. Cl.[6] ..... B41F 35/02; B41L 41/02

[52] U.S. Cl. ..... 101/425; 101/416.1; 101/423; 15/256.52

[58] Field of Search ..... 101/416.1, 423, 425; 355/296, 297, 299, 301–304; 15/106, 111, 38, 256.5, 256.51, 256.52, 256.53

[56] References Cited

U.S. PATENT DOCUMENTS

| | | | |
|---|---|---|---|
| 4,483,611 | 11/1984 | Matsuura et al. | 355/15 |
| 4,494,863 | 1/1985 | Laing | 355/15 |
| 4,779,558 | 10/1988 | Gabel et al. | 101/416.1 |
| 4,786,943 | 11/1988 | Fukae et al. | 355/15 |
| 4,841,862 | 6/1989 | Seefried | 101/425 |
| 4,999,679 | 3/1991 | Corbin et al. | 355/303 |
| 5,181,470 | 1/1993 | Barrois et al. | 101/425 |
| 5,207,160 | 5/1993 | Harada | 101/423 |
| 5,241,908 | 9/1993 | Tateishi | 101/423 |
| 5,245,925 | 9/1993 | Switall et al. | 101/425 |
| 5,329,344 | 7/1994 | Gerbasi et al. | 355/301 |

*Primary Examiner*—Edgar S. Burr
*Assistant Examiner*—Lynn D. Hendrickson
*Attorney, Agent, or Firm*—Oliff & Berridge

[57] ABSTRACT

A printing cylinder cleaning apparatus includes a brush roller having brush fibers planted on its outer surface and opposed to a printing cylinder for movements to and away from a position where the brush fibers contact a surface of the printing cylinder, and includes a rotational driver for rotating the brush roll. The brush roller is contained in a casing which also contains a scraper for biting contact with the brush roll and a dust collector for receiving dust removed by the scraper. The scraper is rotationally supported to casing to follow and rotate with rotation of the brush roll or to be rotationally driven by a motor. The scraper may be an elongated polygonal bar twisted in an intermediate portion, or having a splined or knurled outer circumferential configuration.

12 Claims, 5 Drawing Sheets

PRINTING CYLINDER CLEANING APPARATUS

BACKGROUND OF THE INVENTION

This invention relates to an apparatus for cleaning a printing cylinder of a printing machine and, more particularly, to an improvement of a printing cylinder cleaning apparatus of a printing machine of a type that includes a cleaning brush for rotational contact with a blanket cylinder or the like to sweep up lint or other dust therefrom, and a scraper for removing such dust from the cleaning brush.

Printing cylinders in printing machines typically require periodic cleaning to remove ink sediment, lint or other dust therefrom. Among various types of such cleaning heretofore proposed, an apparatus uses a brush roll contained in a box-shaped casing having an aperture such that the brush roll supported for rotation is partly exposed beyond the aperture. The brush roll is rotated by a motor, and rotationally contacts a blanket cylinder beyond the aperture to scratch or scrape off lint or ink sediments from the surface of the cylinder. The casing also contains a scraper for biting engagement with the brush of the brush roll to remove dust therefrom.

In the existing cleaning apparatus of this type, the scraper is used to remove dust from the brush roll, and it is held in the casing such that it partly bites into the brush roll. The scraper has a rectangular cross section such that one of its edges enters into the brush roll to increase its dust removing effect. The scraper is also positionally related with the brush roll such that the tangential line passing their contact point extends to a dust collector located at the bottom of the casing to prevent scattering of dust removed from the brush roll by the scraper.

In operation of the existing cylinder cleaning apparatus, the scraper removes dust from the brush of the brush roll and makes it drop onto the dust collector at the bottom of the casing. Some of the dust, however, adheres to and remains on the scraper itself, and accumulates on the scraper after a long use of the apparatus. Such accumulated dust sometimes drops in a mass to the bottom of the casing, and may prevent smooth transportation of dust in the dust collector. The scraper therefore also needs its own periodic cleaning. Moreover, although the brush roll and the scraper are positionally related to direct the dust removed from the brush along the tangential line passing their contact point, accumulated dust on the fixed scraper may prevent such intended movements of the dust, and may even deviate it in all directions toward wall surfaces and other portions in the casing other than toward the dust collector. This inevitably promotes fouling of the casing interior.

OBJECTS AND SUMMARY OF THE INVENTION

It is therefore an object of the invention to provide a printing cylinder cleaning apparatus minimizing adhesion of dust to a scraper during removal of the dust from a brush roll by the scraper.

A further object of the invention is to provide a printing cylinder cleaning apparatus reliably directing the dust removed by the scraper and thereby minimizing the angle of expansion of the dust running route in a casing.

A still further object of the invention is to provide a printing cylinder cleaning apparatus capable of varying the biting behavior of the scraper into the brush roll in the axial direction of the brush roll to increase the effectiveness of the dust removal behavior.

In order to achieve the objects, a first aspect of the invention lies in a printing cylinder cleaning apparatus for cleaning a surface of a printing cylinder by rotationally engaging a brush roll to the cylinder in a printing machine, comprising:

- a brush roll having brush fibers planted, and opposed to the printing cylinder for movements to and away from a position where the brush fibers contact a surface of the printing cylinder;
- rotational driving means for rotating the brush roll;
- a casing containing the brush roll;
- a scraper contained in the casing and supported in biting contact with the brush roll; and
- a dust collector contained in the casing to receive dust removed by the scraper,
- the scraper being supported for free rotation relative to the casing to follow and rotate with rotation of the brush roll.

A second aspect of the invention lies in a printing cylinder cleaning apparatus for cleaning a printing cylinder by rotationally engaging a brush roll to the cylinder in a printing machine, comprising:

- a brush roll having brush fibers planted, and opposed to the printing cylinder for movements to and away from a position where the brush fibers contact a surface of the printing cylinder;
- rotational driving means for rotating the brush roll;
- a casing containing the brush roll;
- a scraper contained in the casing and supported in biting contact with the brush roll;
- a dust collector contained in the casing to receive dust removed by the scraper; and
- rotation transmitting means coupled to the rotational driving means to rotate the scraper.

In any of the foregoing aspects of the invention, the scraper may have a polygonal cross section which is twisted about its own axis at an axial intermediate portion, or may alternatively have axially elongated recesses on its surface.

Since the scraper itself is also rotated following to rotation of by brush roll or rotationally driven by a motor, and the dust does not remain on the scraper and it is splashed along a tangential line passing the contact point between the brush roll. The structure rotating both the brush roll and the scraper keeps the surface of the scraper clean and smooth, which ensures a constant running direction of dust and quite a small angle of expansion of the dust running route. The apparatus therefore minimizes adhesion of dust to the scraper and to interior surfaces of the casing, and hence alleviates cleaning maintenance therefor.

DESCRIPTION OF THE PREFERRED EMBODIMENTS

Embodiments of the invention are explained below with reference to the drawings.

Figure 1:
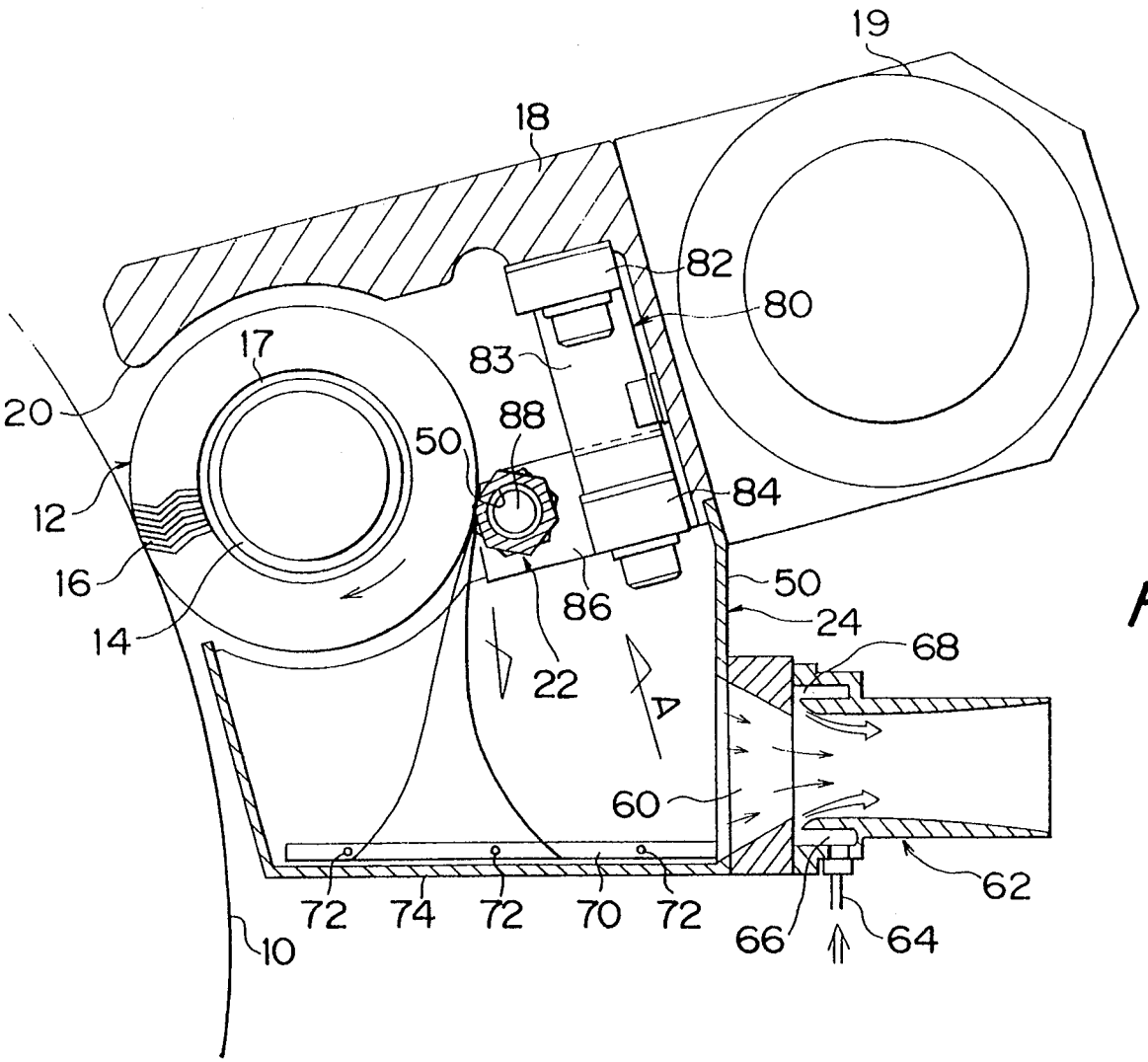
FIG. 1 is a longitudinal cross-sectional view of a printing cylinder cleaning device according to an embodiment of the invention.
Figure 2:
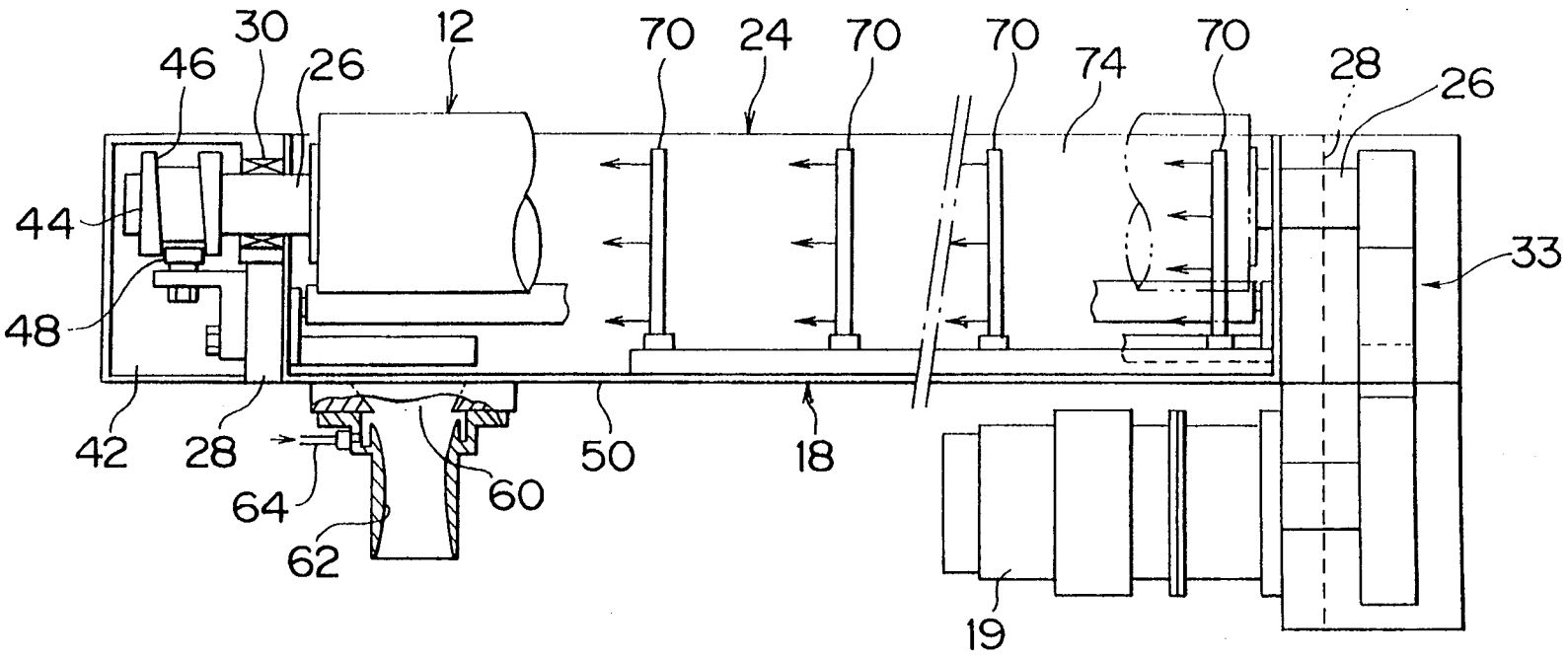
FIG. 2 is a horizontal cross-sectional view of the same printing cylinder cleaning apparatus.

With reference to FIGS. 1 and 2 showing a printing cylinder cleaning apparatus taken as an embodiment of the invention, a blanket cylinder 10 is shown as being a printing cylinder to be cleaned by the apparatus. The apparatus includes a dry-type brush roll 12 opposed to the blanket cylinder 10 and movable in back and forth directions with respect to the printing cylinder 10. The brush roll 12 includes a cylindrical roll core 14 and a ground fabric 17 having a number of brush fibers 16 planted therein and bonded to the outer circumferential surface of the roll core 14. The brush fibers 16 of the dry brush roll 12 are nylon fibers each having a diameter of about 0.2 to 0.3 mm. The brush fibers 16 therefore contact with the blanket cylinder 10 during rotation and clean it by sweeping up dust with their outer ends from the surface of the blanket cylinder 10. In this embodiment, the brush fibers 16 are buckled by bending them in zigzags and are planted in the ground fabric 17 such that distal ends of the brush fibers 16 incline in all directions from tangential lines of the brush roll 12. Therefore, the brush fibers 16 opposed to the rotational direction of the blanket cylinder 10 in every portion thereof scratch and slide on the surface of the blanket cylinder 10 with their distal ends and can yield in the length direction of the fibers when contacting the blanket cylinder 10. The dry-type brush roll 12 has a roll length substantially the same as that of the blanket cylinder 10 to be cleaned, and it is mounted to the casing 18 for movements to and away from the blanket cylinder 10 while rotated by a motor.

The casing 18 is a box-shaped container containing the brush roll 12 therein, and it is moved by an engaging device to and away from the blanket cylinder 10. The casing 18 has an aperture 20 in one of its surfaces opposed to the blanket cylinder 10 to partly expose the brush roll 12 therein beyond the aperture 20. The casing 18 also contains a scraper 22 which can bite into the brush of the brush roll 12. The scraper 22 is an elongated polygonal bar having a length not less than the brush roll 12 and disposed at a position opposite to the aperture 20 to extend in parallel with the brush roll 12 such that the outer marginal portion of the scraper 22 overlaps with and bites into the brush roll 12. Therefore, the scraper 22 contacts with the brush roll 12 during rotation with its edges biting into an outer marginal portion of the brush, and thereby swats down dust entrapped between the brush fibers 16. The casing 18 also includes at its bottom a cassette container 24 removably engaged with the upper part of the casing 18 to behave as a dust collector for receiving lint, ink sediment or other dust swept from the blanket 10 by the brush roll 12 and swatted down from the brush roll 12 by the scraper 22.Extended from opposite ends of the brush roll 12 are two rotational axes 26 which are inserted in end plates 28 provided at opposite sides of the casing via bearings 30. An air motor 19, for example, is provided in a separate chamber at one side of the casing 18 behind the brush roll 12 to rotationally drive the brush roll 12 via a gear transmission mechanism 33. A part of the interior of the casing 18 defined by one of the end plates 28 remote from the gear transmission mechanism 33 and side plates merging therewith behaves as a cam chamber 42. Provided in the cam chamber 42 as shown in FIG. 2 is a cylindrical cam 44 supported on a roll rotational shaft 26 extending in the chamber 42. Also provided in the cam chamber 42 is a cam roller 48 held in a stationary position for engagement with a cam groove 46 provided on the outer circumferential surface of the cylindrical cam 44. The cam groove 46 defines surfaces diagonal of the roller shaft to cause axial reciprocal movements of the brush roll 12 due to its own rotation.

The cassette container 24 used as a dust collector includes a dust discharging device for effectively discharging dust received in this container 24. The dust discharging device includes, as illustrated, a dust outlet 60 located near an end of a back plate 50 of the cassette container 24, and an ejector 62 connected to the dust outlet 60 to generate an evacuating negative pressure. Connected to the ejector 62 is an air supply pipe 64 to supply an interior annular chamber 66 with compressed air and to jet it out at a high speed through a ring nozzle 68 provided in an inner circumferential surface of the ejector 62. Thereby, a negative pressure is produced in the center of the path made by the outlet 60 to discharge dust containing air from the cassette container 24.

In order to guide dust to the dust outlet 60, the cassette container 24 includes a plurality of nozzle pipes 70 extending at right angles of the brush roll 12 and the scraper 22 such that air blown from the nozzle pipes 70 makes a transporting air flow toward the outlet 60. These nozzle pipes 70 are held at a uniform height from the bottom 74 of the cassette container 24. Each of the nozzle pipes 70 has air blowing bores 72 oriented to blow air toward the dust outlet 60 and to make a bowing blowing angle of 20 to 25 degrees (for example, 22 degrees) such that an air flow toward the outlet 60 is produced along the bottom of the cassette container 24. A low value of the blowing pressure from the nozzles is chosen to prevent blowing of air through a gap between the cassette container 24 and the brush roll 12 at the aperture 20.

Figure 3A:
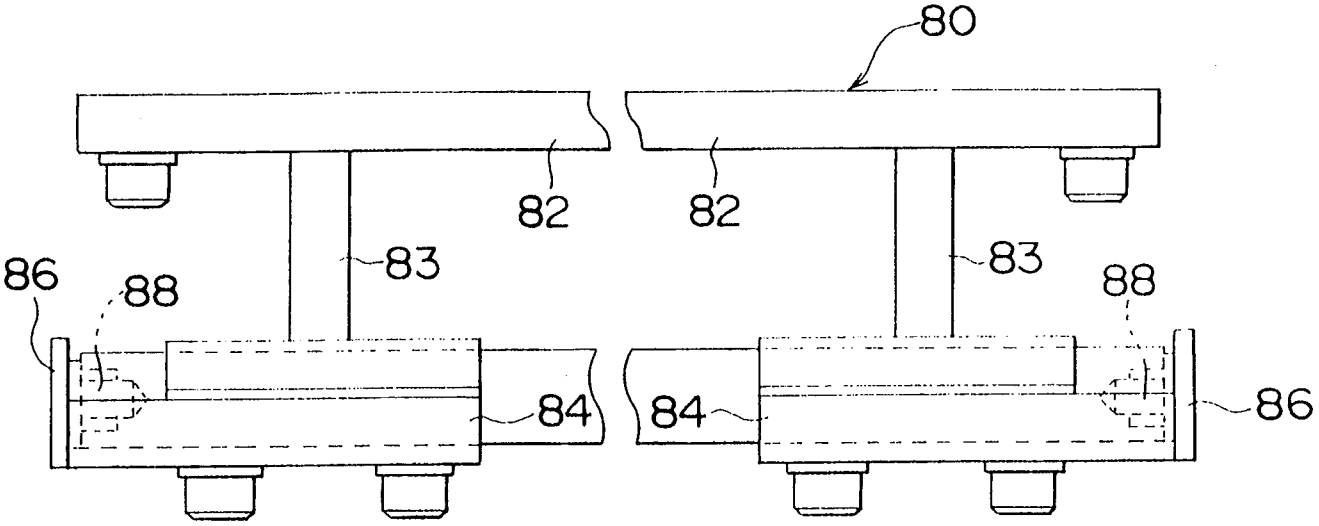
FIG. 3A is a plan view of a scraper holder.
Figure 3B:
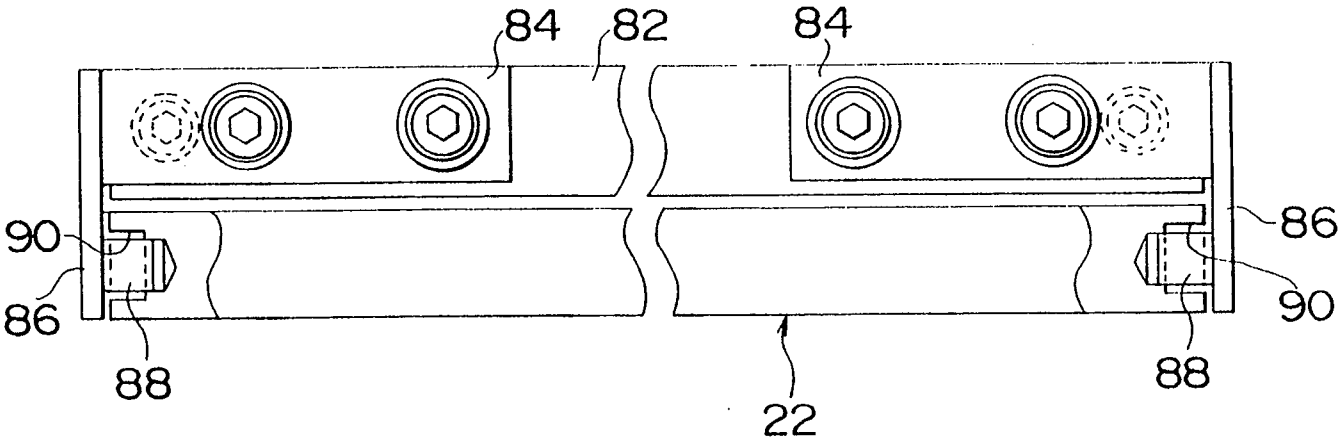
FIG. 3B is a view of the apparatus from the arrow A of FIG. 1.

In the construction described above, the scraper 22 in the cleaning apparatus according to the embodiment is rotatably supported by the casing 18 to contact with and rotated by the brush roll 12 driven by the brush driving motor 19. This status is shown in FIGS. 3A and 3B in greater detail. A holder 80 is provided to support the scraper 22 to the casing 18. The holder 80 has a mount plate 82 attached to a back plate of the casing 18. Mounted to the mount plate 82 are holder bodies 84 via arms 83 for adjusting the position of the scraper 22 such that the scraper 22 is opposed to the brush roll 12. The holder bodies 84 directly support the scraper 22 by rotatably supporting opposite ends of the scraper 22 with a pair of brackets 86 thereof opposed to the end surfaces of the scraper 22. The pair of brackets 86 have supporting projections 88 extending along a common line therefrom and inserted in bearing bores 90 in the end plates of the scraper 22 to rotatably support the scraper 22.

Figure 4A:
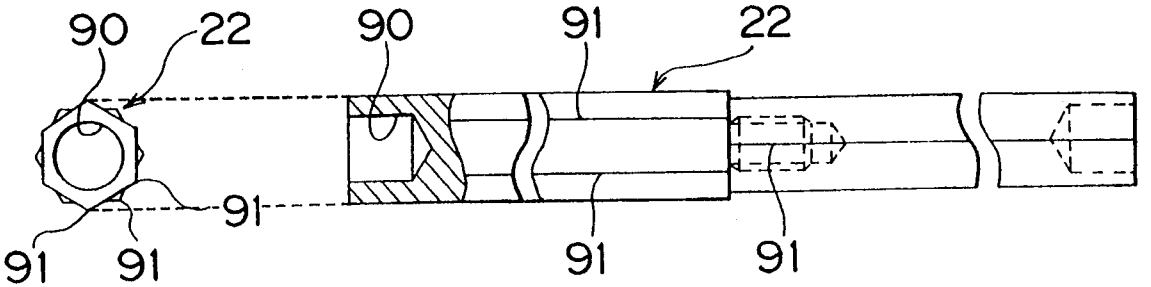
FIG. 4A is an end view and a side elevational view of an example of the scraper.

The scraper 22 has a construction as explained below in greater detail with reference to FIG. 4A. The scraper 22 is generally an elongated bar having a polygonal cross section such as a hexagonal cross section as illustrated. The scraper 22 is twisted by 30 degrees about its own axis at an intermediate portion in the axial direction thereof. That is, edges 91 of the right portion of the scraper 22 are shifted by a half pitch in the rotational direction from those of the left portion of the scraper 22 such that, as best shown in the left-side figure viewed from an axial end of the scraper 22, edges 91 of the back portion appear between edges 91 of the front portion. As a result, when the scraper 22 contacts the brush roll 12, biting status of the edges 91 of the scraper 22 is different between the right portion and the left portion. That is, a time lag is produced between biting of an edge of the right portion and biting of an edge of the left portion.

In the cleaning apparatus having the above-described construction, by rotatably driving the brush roll 12 by the motor 19, the brush fibers 16 sweep up ink sediment, lint and other dust from the surface of the blanket cylinder 10 by an scraping or scratching motion, and such dust entrapped in the brush fibers 16 is taken into the interior of the casing 18. After that, the brush roll 12 is dry-cleaned by the construction which does not use any cleaning liquid such as ink solvent. The scraper 22 rotatably supported by the holder 80 is rotated following to rotation of the brush roll 12. During this rotation, the edges of the polygonal cross section of the scraper 22 bite into and vibrates in the brush fibers 16, and swat off the dust therefrom. At the same time, since the scraper 22 itself also rotates, the dust cannot remain thereon, and adhesion and accumulation of on the scraper 22 are minimized. Moreover, since the contact portions of the brush roll 12 and the scraper 22 move in the same direction during rotation thereof, there is no possibility that the scraper 22 itself behaves to prevent rotation of the brush roll 12 unlike in the existing apparatus, and the removed dust is reliably directed to a tangential line common to both of them and moves within a small angle of dispersion. Therefore, the removed dust does not scatter over a wide range in the casing 18. Moreover, an experiment showed that the twisted configuration of the scraper gives a high dust removal function. It is assumed that a difference in swatting frequency between two portions of the scraper be more effective to an increased dust removal function.

Figure 4B:
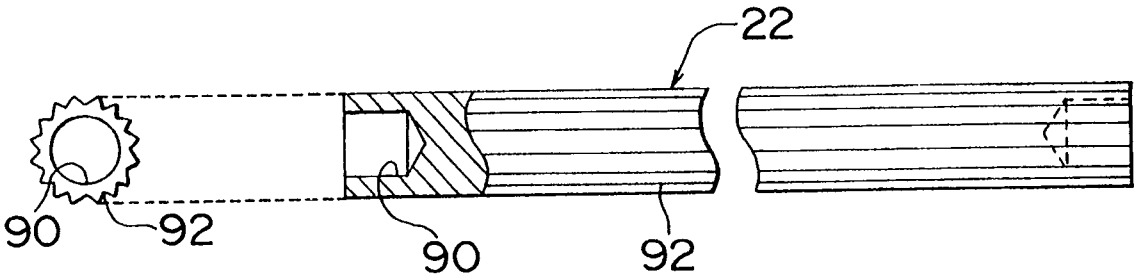
FIG. 4B is an end view and a side elevational view of a further example of the scraper.
Figure 4C:
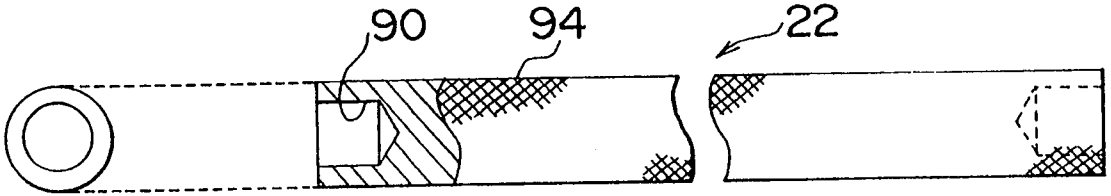
FIG. 4C is an end view and a side elevational view of a still further example of the scraper.

The scraper 22 may alternatively be configured to have axially extending splines on the outer surface thereof as shown in FIG. 4B in which the scraper 22 has a splined configuration 92 on the outer surface thereof. Another alternative configuration of the scraper 22 is shown in FIG. 4C in which the outer surface of the scraper 22 is knurled to exhibit a reticulation 94. These alternative structures also contribute to an effective dust removal function. The scraper 22 may also be configured to have spiral grooves or splines on the outer surface thereof.

Figure 5:
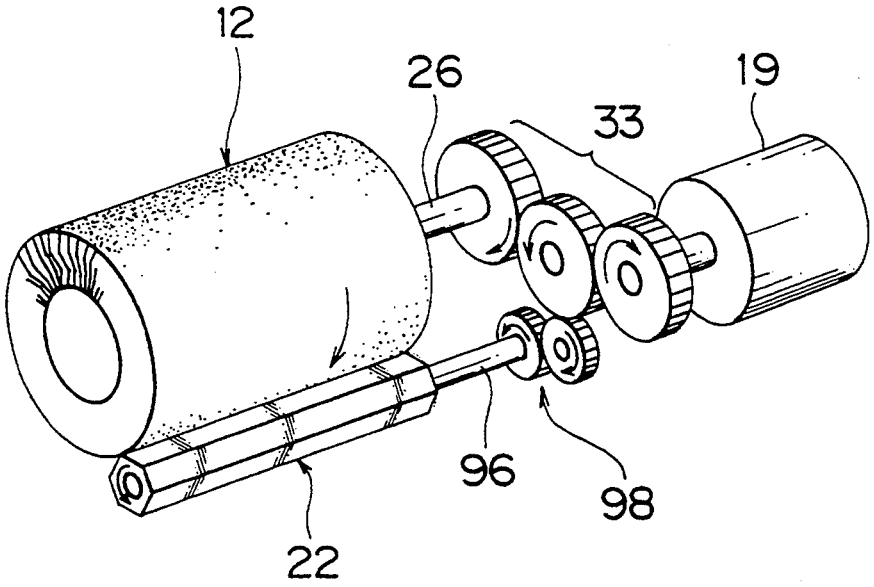
FIG. 5 is a schematic diagram showing a rotation transmitting system for rotating the scraper.

In the embodiments referred to above, the scraper 22 may be forcibly rotated by a motor. As schematically shown in FIG. 5, such a structure may readily be attained by extending one of the support projections 88 (nearer to the brush rotating motor) to be as a rotatabl shaft 96, and by transmitting rotation of the motor to the shaft 96 via a scraper rotating gear train 98 interposed in the gear transmission mechanism 33. As a result, the scraper 22 can be rotated independently by the motor 19 with a desired ratio relative to rotation of the brush roll 12. By experimentally selecting an optimum rotational ratio, a much higher dust removal behavior can be expected. This modification may also uses any one of the structures of the scraper 22 shown in FIGS. 4A to 4C.

Although the invention has been shown and described with respect to preferred embodiments thereof, it should be understood by those skilled in the art that the foregoing and other changes and omissions in the form and detail thereof may be made therein without departing from the spirit and scope of the invention, which is to be limited and defined only as set forth in the following claims.

What is claimed is:

1. A printing cylinder cleaning apparatus for cleaning a surface of a printing cylinder by rotationally engaging a brush roll to the cylinder in a printing machine, comprising:

a brush roll having brush fibers planted, and opposed to said printing cylinder for movements to and away from a position where said brush fibers contact a surface of said printing cylinder;

rotational driving means for rotating said brush roll;

a casing containing said brush roll;

a scraper contained in said casing and supported in biting contact with said brush roll; and a dust collector contained in said casing to receive dust removed by said scraper, said scraper being supported for free rotation relative to said casing to follow and rotate with rotation of said brush roll.

2. The printing cylinder cleaning apparatus according to claim 1 wherein said scraper is an elongated polygonal twisted bar having a polygonal cross section and twisted about its own axis in an axial intermediate portion thereof.

3. The printing cylinder cleaning apparatus according to claim 1 wherein said scraper is an elongated bar having recesses axially extending on an outer surface thereof.

4. The printing cylinder cleaning apparatus according to claim 1 wherein a respective said brush fiber is a buckled fiber bent in zigzags.

5. The printing cylinder cleaning apparatus according to claim 1 wherein said dust collector includes:

a dust outlet opening at a portion of said casing and supplied with an evacuating negative pressure; and air blowing means for making an air flow near a bottom of said casing to float and direct dust removed by said brush fibers toward said dust outlet.

6. A printing cylinder cleaning apparatus for cleaning a printing cylinder by rotationally engaging a brush roll to the cylinder in a printing machine, comprising:

a brush roll having brush fibers planted, and opposed to said printing cylinder for movements to and away from a position where said brush fibers contact a surface of said printing cylinder;

rotational driving means for rotating said brush roll;

a casing containing said brush roll;

a scraper contained in said casing and supported in biting contact with said brush roll;

a dust collector contained in said casing to receive dust removed by said scraper; and rotation transmitting means coupled to said rotational driving means to rotate said scraper.

7. The printing cylinder cleaning apparatus according to claim 6 wherein said scraper is an elongated polygonal twisted bar having a polygonal cross section and twisted about its own axis in an axial intermediate portion thereof.

8. The printing cylinder cleaning apparatus according to claim 6 wherein said scraper is an elongated bar having recesses axially extending on an outer surface thereof.

9. The printing cylinder cleaning apparatus according to claim 6 wherein a respective said brush fiber is a buckled fiber bent in zigzags.

10. The printing cylinder cleaning apparatus according to claim 6 wherein said dust collector includes:

a dust outlet opening at a portion of said casing and supplied with an evacuating negative pressure; and air blowing means for making an air flow near a bottom of said casing to float and direct dust removed by said brush fibers toward said dust outlet.

11. A printing cylinder cleaning apparatus for cleaning a surface of a printing cylinder by rotationally engaging a brush roll to the cylinder in a printing machine, comprising:

a dry-type brush roll operative in a dry state without using a cleaning liquid, said brush roll having brush fibers planted and opposed to said printing cylinder for movements to and away from a position where said brush fibers contact a surface of said printing cylinder, said brush fibers each being a buckled fiber bent in zigzags;

rotational driving means for rotating said brush roll;

a casing containing said brush roll;

a scraper contained in said casing and supported for free rotation relative to said casing to follow and rotate with rotation of said brush roll while maintaining biting contact with said brush roll; and a dust collector contained in said casing to receive dust removed by said scraper, and including a dust outlet opening at a portion of said casing and supplied with an evacuating negative pressure, and air blowing means for making an air flow near a bottom of said casing to float and direct dust removed by said brush fibers toward said dust outlet.

12. A printing cylinder cleaning apparatus for cleaning a surface of a printing cylinder by rotationally engaging a brush roll to the cylinder in a printing machine, comprising:

a dry-type brush roll operative in a dry state without using a cleaning liquid, said brush roll having brush fibers planted and opposed to said printing cylinder for movements to and away from a position where said brush fibers contact a surface of said printing cylinder, said brush fibers each being a buckled fiber bent in zigzags;

rotational driving means for rotating said brush roll;

a casing containing said brush roll;

a scraper contained in said casing and supported in biting contact with said brush roll;

rotation transmitting means coupled to said rotational driving means to rotate said scraper; and a dust collector contained in said casing to receive dust removed by said scraper, and including a dust outlet opening at a portion of said casing and supplied with an evacuating negative pressure, and air blowing means for making an air flow near a bottom of said casing to float and direct dust removed by said brush fibers toward said dust outlet.

* * * * *